United States Patent [19]

Lohness

[11] 3,955,451

[45] May 11, 1976

[54] HAND-HELD SPIN-TYPE DRIVER TOOL

[75] Inventor: William F. Lohness, Jonesville, Mich.

[73] Assignee: Vaco Products Company, Chicago, Ill.

[22] Filed: Feb. 14, 1975

[21] Appl. No.: 550,163

[52] U.S. Cl. ..... 81/177 R; 145/61 C
[51] Int. Cl.[2] ..... B25B 13/00; B25G 3/12
[58] Field of Search ..... 81/177 R, 177 G; 145/50 R, 61 R, 61 C, 61 H; 403/298, 354

[56] References Cited

UNITED STATES PATENTS

| | | | |
|---|---|---|---|
| 871,154 | 11/1907 | Wood | 403/359 X |
| 1,660,537 | 2/1928 | Waskom | 145/61 R |
| 2,015,430 | 9/1935 | Matthews et al. | 403/359 X |
| 3,292,678 | 12/1966 | Noga | 145/50 R |
| 3,405,748 | 10/1968 | Sorteberg | 145/50 R |
| 3,592,247 | 7/1971 | Solf | 145/61 R |

FOREIGN PATENTS OR APPLICATIONS

| | | | |
|---|---|---|---|
| 290,807 | 3/1953 | Switzerland | 403/298 |
| 1,052,369 | 1/1954 | France | 145/61 C |

*Primary Examiner*—Al Lawrence Smith
*Assistant Examiner*—James G. Smith
*Attorney, Agent, or Firm*—Dressler, Goldsmith, Clement & Gordon, Ltd.

[57] ABSTRACT

A new form of assembly for a high torque capability spin-type driver tool is disclosed. The tool has a shaft of uniform cross-sectional dimension with an elongated segment of substantially reduced cross-sectional dimension or shape at one end. A plurality of fin-shaped members extend radially outward along the reduced cross-sectional portion to provide a coupling for applying the turning force or torque to the shaft. The shaft is adapted for use with handled driver tools, such as screwdrivers and nutdrivers as well as with power driving tools. The reduced cross-sectional dimension segment and fin-shaped members present an axially smooth surface about which a press-fitted handle grip will contiguously engage. The fin-shaped members prevent the handle grip from slipping rotationally about the shaft in the presence of torsional forces.

7 Claims, 9 Drawing Figures

HAND-HELD SPIN-TYPE DRIVER TOOL

BACKGROUND OF THE INVENTION

The present invention relates to spin-type driver tools that are subject to torsional forces and more specifically to the shank portions to which turning forces are applied to such driver tools.

The most common of the driver tools of the type being discussed here include the well known hand-held spin-type driver tools such as screwdriver, nutdrivers, and allen hex drivers, to mention a few. Spin-type driver tools, however, also include tools adapted for use with power driving tools such as electric drills and impact mechanisms. All of these driver tools characteristically include a shank portion consisting of an elongated shaft, having at one end some type of driver means adapted to engage a complementary fastener in known manner. The other end of the shaft supports a handle grip or presents some type of engaging surface to which a turning force can be applied.

In the normal use of handled type driver tools, turning forces are applied to the handle grips which are coupled to the shafts so that they transmit torque to the driver means which in turn transfers these forces to a complementary fastener engaged by the head on the shaft. For the tool to be effective, the handle grip must not slip around the shaft when the turning forces are applied. Where the shaft about which a handle grip is fitted is tubular, there is nothing for the handle grip to engage to prevent it from slipping in response to the turning forces. Therefore such shafts are typically provided with some type of protrusion means to engage the surrounding handle material to prevent such slippage. Protrusion means positioned on the shaft are well known in the prior-art and many different arrangements of them are employed. For example, one prior-art arrangement utilizes a pair of oppositely disposed fin-members in recessed portions on the shaft. Another prior-art arrangement has the end of the shaft flattened to a screwdriver-type-head appearance. Yet another prior-art arrangement has the end of the shaft squared or otherwise configurated into a noncircular shape. Still another type uses small splines near the end of the shaft.

The handle grips used on driver tools are commonly made of plastic or wood because of the comfort, grippability and electrical insulating properties of these materials. From a manufacturing standpoint, handle grips made from these materials are best assembled with the driver shaft by the press-fit technique. According to this procedure, the handle grip is provided with an undersized axial bore in one end where the handle grip is forced onto the end of the driver shaft. The force with which this is done causes the handle material adjacent the axial bore to expand about the exterior surface of the shaft and then compress onto the shaft to form a snug fit therewith.

Driver shafts incorporating the prior-art protrusion arrangements mentioned above, however, have not proved effective for high torque applications when assembled with handle grips by the press-fit technique because they do not present an axially smooth surface about which the handle material can readily engage. This may be due to the fact that in many instances much of the surface area of the prior-art protrusions intended for torque transmission is crouched in axially recessed portions on the shaft or the protrusions are arranged too close together. This results in the formation of natural pockets adjacent the protrusions where the engaging handle material will not extend and hence will not contact the shaft.

The shortcomings of the prior-art protrusion arrangements become readily apparent in torsional tests conducted on plastic handled driver tools. Torque standards for hand tools of the type being discussed here, have been established by government agencies to provide some indication to measure quality and utility of hand tools. Among other things these standards specify torsional moment tests which tools must be able to withstand. The standards are subject to review and are amended from time to time. For example, the General Service Administration standards now require that handled driver tools for use by its agencies must be able to surpass torsional requirements of up to 250 in.-lbs. at an elevated temperature of 125° Fahrenheit.

Handled driver tools equipped with the above mentioned prior-art protrusion arrangements are unable to meet the torque standards at elevated temperatures. The standard plastic handle grips used on handled driver tools experience some degree of softening at high temperatures. This loosens the fit between the handle grip and the shaft of prior-art devices, with the result that the driver fails.

FEATURES OF THE INVENTION

With the foregoing in mind, it is a feature of the present invention to provide a driver tool having an improved driver shaft-to-handle mating construction.

It is another feature of the present invention to provide an improved driver fin construction that is effective to prevent relative rotational movement or slippage between the handle grip and the shaft of a hand-held type driver tool in the presence of torsional forces even at elevated temperatures.

It is another feature of the present invention to provide an improved driver shaft fin construction having increased surface area but with substantially no increase in over all dimensions of the driver shaft.

It is another feature of the present invention to provide an improved driver shaft fin construction that presents an axially smooth surface about which a handle grip can contiguously be fitted.

BRIEF SUMMARY OF THE INVENTION

The present invention is directed to an improved shank and assembly system for a spin-type driver tool including a shaft of uniform cross-sectional dimension having at one end an elongated segment of substantially reduced cross-sectional dimension. A pair of rigid fin-shaped members integral with the shaft extend radially outward from the reduced cross-sectional dimension segment of the shaft. The fin-shaped members are oppositely disposed and extend parallel to each other along substantially the entire length of the reduced cross-sectional dimension segment of the shaft. The fin-shaped members are adapted to be engaged by a turning force and couple it to the shaft. Turning forces can be applied to the fin-shaped members by means such as an electric drill, or the shank may be fitted with a handle grip for operation as a hand tool.

The driver fin construction according to the present invention is ideally suited to receive handle grips that are press-fitted onto the shaft. The reduced cross-sectional dimension segment at the end of the shaft and the fin-shaped members present an axially smooth surface about which the handle material can compress during the press-fitting operation. This produces in a handle grip that is in contiguous engagement with the entire surface area of the fin-shaped members as well as the portion of the shaft it encompasses. That is, the present invention provides a system whereby a handle may be press fitted onto the grip shank of the shaft smoothly and efficiently with the interior of the handle gripping and engaging the entire grip shank portion of the shaft; there being no recesses to leave void, non-contiguous regions between the interior of the handle and the exterior surface of the grip shank.

Further, the shank construction according to the present invention represents a significant advance over the prior-art. The fin-shape members present a greater surface area for engagement with a turning force which increases resistance to slippage in the presence of torsional forces. This is especially important in the case of hand-held driver tools, which under torque standards set by the General Services Administration are tested under high temperature conditions, were the handle material is subject to softening.

In addition, the greater surface area presented by the fin-shaped members embodying the present invention is achieved while maintaining the overall dimensions of the driver shaft substantially the same as prior-art devices. The driver fin construction according to the present invention has the fins extend outwardly along an elongated end of the shaft that is significantly reduced in cross-sectional dimension from the rest of the shaft. In this manner a large surface can be presented by the fins without suffering an overall increase in the dimensions of the driver shank. Thus handle grips of standard exterior size and design as used on prior-art driver tools can be used with the present invention.

DETAILED DESCRIPTION

Figures 1A, 1B, 1C, 1D:
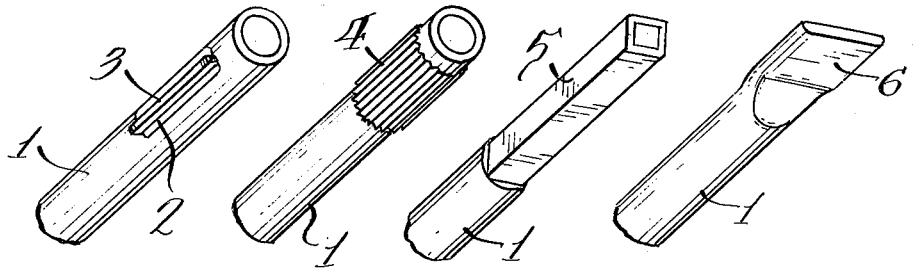
Fig. 1a. Fig. 1b. Fig. 1c. Fig. 1d. PRIOR ART
FIGS. 1*a* – 1*d* are fragmentary perspective views of shank portions of driver tool shafts illustrating various prior-art constructions.

Referring now to the drawings, FIGS. 1*a* – 1*d* illustrate shank portions of driver tools embodying known prior-art driver shank protrusion arrangements. In FIG. 1a, there is shown of a hollow tubular driver shaft 1 having oppositely disposed elongated recessed portions 2 formed on the shaft. Fin members 3 are formed in the recessed portions 2 and extend radially outwardly therefrom slightly beyond the outer surface of shaft 1. The protrusion arrangement shown in this figure is especially poor for receiving handle grips assembled with the shank by the press-fit technique. Because fin-members 3 do not extend to the end of shaft 1 and are partially recessed in the depressions 2, the handle grip fitted on to this shaft would engage only that small surface portion of fin-members 3 that extends beyond the outer surface of shaft 1, almost totally reducing the effect of the fins. The fin arrangement of FIG. 1a is not conducive to receiving even those handle grips made of plastic either, because cold flow movement of the plastic material experienced in press-fitted arrangements do not spread the handle material well into recesses 2 to engage a significant surface portion of fins 3.

FIG. 1b shows a hollow tubular driver shaft 1 provided with a longitudinally splined shank arrangement 4 which extends completely around the surface of shaft 1. In this arrangement, the splines have too little surface area and are too closely spaced to effectively receive handle grips by the press-fit technique for high torque capability assemblies.

Additional prior-art protrusion arrangements are shown in FIGS. 1*c* and 1*d*. In FIG. 1c the protrusion arrangement is in the form of a square shaft segment 6, and in FIG. 1*d*, the end of the driver shaft 1 is flattened to a screwdriver-type-head appearance. Both such systems fail to provide high torque capability tools when press fit assembled with handles.

Figure 2:
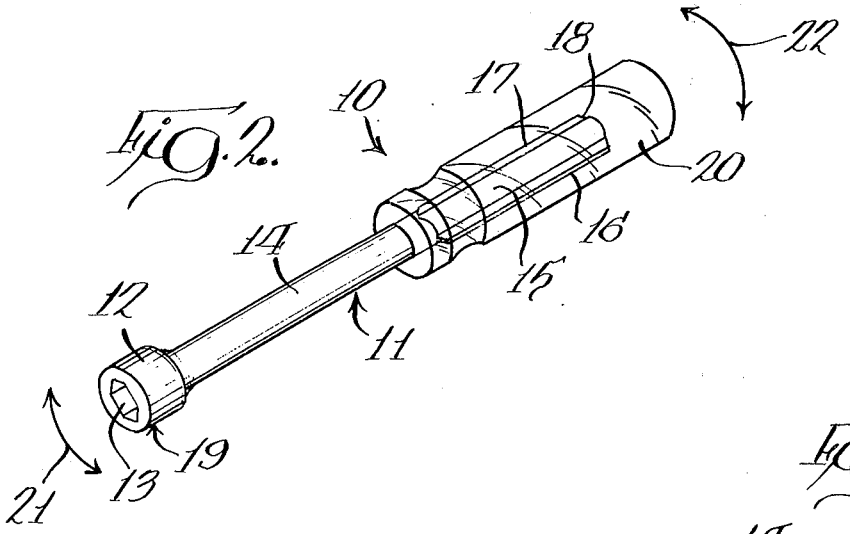
FIG. 2 is a perspective view of an exemplary embodiment of a nutdriver tool incorporating the present invention.

FIG. 2 illustrates an exemplary embodiment of a handled nutdriver tool incorporating the present invention. Indicated generally at 10, the nutdriver includes a hollow tubular shaft 11 made of steel. It is noted that shaft 11 may take on other shapes such as rectangular or hexagonal and need not be hollow. Positioned at one end of shaft 11 and coaxial therewith is a socket wrench head 12 of standard design well known in the art. The front end 19 of the socket 12 defines an opening to a hexagonal walled cavity 13 adapted to receive a nut or bolt fastener (not shown) of the same size. The back of the cavity 13 (not shown) opens into the hollow shaft 11 to define a bolt clearance hole. The socket 12 may be any one of a number of specified sizes to accommodate different sized nuts and bolt fasteners as is well known in the art; and, as indicated, is exemplary only of the many types of work heads that may be used on tools to advantageously employ the principles of the invention.

Figure 3:
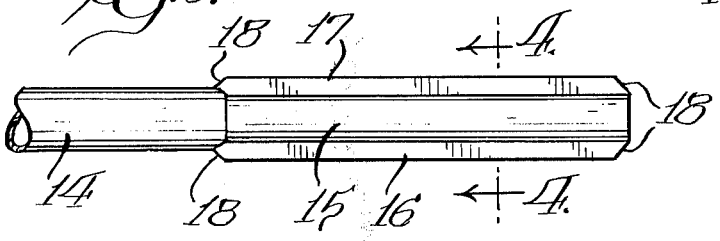
FIG. 3 is a fragmentary view of a shank for a driver tool illustrating the present invention.
Figure 4:
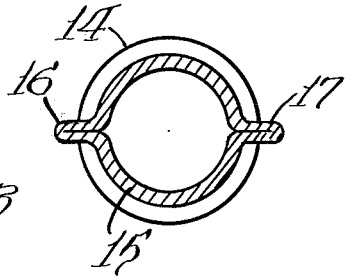
FIG. 4 is a sectional view taken along line 4 — 4 of FIG. 3.

A major portion of the length of the shaft 11 may be of uniform diameter as shown at 14; the shank 15, however, opposite the socket 12, is of substantial length and of significantly reduced diameter compared to the diameter of major portion 14. Extending radially outwardly from the reduced diameter shank segment 15 are a pair of oppositely disposed integral fin-shaped members 16 and 17. As best seen in FIGS. 3 and 4, the fin-shaped members 16 and 17 extend outwardly beyond the diameter of major portion 14 of shaft 11 and run parallel to each other along substantially the entire length of the reduced diameter segment 15. The ends of the fin-shaped members are chamfered as shown at 18 in order to present an appropriate surface or edge for a press fitted handle.

A standard design handle grip 20 (FIG. 2) made of plastic or wood is press-fitted onto the reduced diameter shank segment 15 of shaft 11 in known manner. In the press-fitting operation, handle grip 20 would be provided with an axial bore in the front end thereof of substantially the same or slightly smaller diameter than reduced diameter segment 15. The handle grip 20 is forced onto shaft 11 with sufficient force to drive it to or beyond the reduced diameter segment 15 coming to rest at or along major tube diameter 14. If the handle grip 20 is made of plastic material, as shank 15 passes into the undersized bore, the plastic adjacent the passing shank will undergo cold flow movement and conform to the axially smooth surface area of the fins 16 and 17 as well as that portion of shank that it encompasses. Where the handle grip 20 is made of wood, the handle material is compressed against the opposite surfaces of axially exposed fin-shaped members 16 and 17 forming a snug fit therewith. Fin-shaped members 16 and 17 maintain handle grip in fixed relationship with shank 15 in the presense of high torsional forces that may be applied to the nut-driver driver tool 10 as well as those occurring in the ordinary use for which the tool is intended.

As can be appreciated from the foregoing, the unique smooth shank features of the invention, wherein the shank is of uniform configuration along its entire length permits press-fitting of handles without causing voids or breaks in the surface to surface contact between the shank and the interior of the handle.

In use, the nutdriver 10 is grasped about the handle grip 20 and socket 12 is engaged with a nut or bolt fastener (not shown) of the same size in known manner. The nutdriver 10 is turned at the handle grip 20 around the longitudinal axis of shaft 11. This is indicated by arrows 22 which illustrates the direction of force being applied to the handle grip 20. Opposing the turning force 22 is the resisting force of the nut or bolt fastener engaged by socket 12. This force is indicated by arrow 21. Resisting force 21 is transferred along shaft 11 to fin-shaped members 16 and 17 and is distributed over the surface area of the fins which engages handle grip 20. In the ordinary situation, the turning force 22 applied to handle grip 20 by the user will overcome the resisting force and cause shaft 11, socket 12, and the engaged nut or bolt fastener to turn.

By extending the fin-shaped members 16 and 17 radially outwardly from the otherwise smooth surface of the elongated reduced diameter segment or shank 15, smooth, straight fins of substantial width and length are formed. The large fin size prevents movement between shaft 11 and handle grip 20 in the presence of torsional forces even when the handle grip is softened, for example, by high temperatures.

Because the fin-shaped members 16 and 17 extend radially outwardly from reduced diameter segment 15, the overall dimensions of the nutdriver shaft 11 is substantially the same as prior-art devices. Therefore, handle grip 20 may be of standard size and design as used in the prior-art.

Referring now to FIGS. 3 and 4, the reduced diameter segment 15 and fin-shaped members 16 and 17, are formed in a stamping operation in which one end segment of shaft 14 is compressed by complementary opposing jaws of a die having the combined interior configuration of the shape to be formed. As best seen in FIG. 4, the shaft 14 is reduced in diameter to that shown at 15 and the shaft material left over from the reduction is formed into the fin-shaped members 16 and 17. It is understood that shaft 11 from which the reduced diameter segment 15 and fin-shaped member 16 and 17 are formed may be hollow or solid and need not necessarily be round but may, for example, be square.

In a specific example of the nutdriver incorporating the present invention, a hollow tubular steel shaft is used having a major tube diameter of 5/16 in. and 4½ ins. in length. An integral hexagonal socket of the type well known in the art is formed on one end of the shaft.

The socket does not constitute a part of the present invention and therefore, is not discussed except to say that it or any other desired work head may be formed on the shaft in any known manner. The end of the shaft opposite the socket has a 1⅞ in. long segment reduced in diameter to ¼ in. Fin-shaped members extend outwardly 1/16 in. along the length of the reduced diameter segment. A standard plastic handle grip of approximately ¾ in. diameter and 2¼ in. length is press-fitted onto a 2 in. section of the shaft encompassing the reduced diameter segment.

Figure 5:
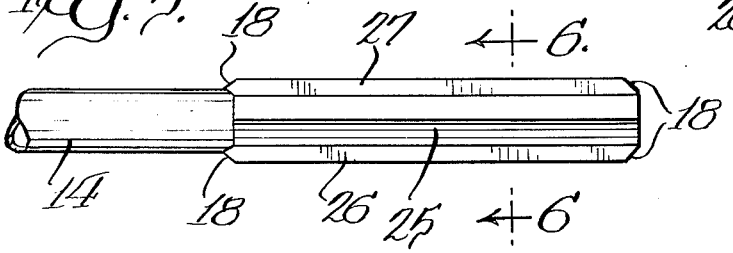
FIG. 5 is a fragmentary view of another embodiment of a shank for a driver tool illustrating the present invention.
Figure 6:
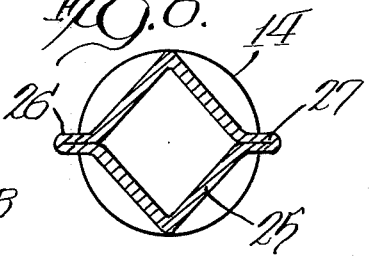
FIG. 6 is a sectional view taken along line 6 — 6 of FIG. 5.

FIGS. 5 and 6 show another embodiment of the present invention where the reduced cross-sectional dimension segment of shaft 11 is square-shaped instead of round as shown in the embodiment of FIGS. 3 and 4. Indicated at 25 the square-shaped reduced cross-section dimension segment has fin-shaped members 26 and 27 extending radially outward from opposite corners beyond the diameter of major tube portion 14. As best seen in FIG. 5, the fin-shaped members 26 and 27 extend over substantially the entire length of reduced cross-sectional dimension segment 25. The ends of the fin-shaped members are chamfered as shown at 28 to present an actually smooth surface.

It is noted that the above description is exemplary of only one of many spin-type driver tools to which the present invention applies. In addition to handled driver tools such as is disclosed here, the present invention is adapted for use with power tools such as hand drills. The reduced thickness segment of the shaft is insertable into the drill chuck and the fin-shaped members maintain the shaft from turning in the chuck in the presence of torsional forces. The fin-shaped members extending from the reduced cross-sectional dimension segment of the shaft according to the present invention need not be oppositely disposed and may comprise more than two in number. For example, the invention may consist of three fin-shaped members disposed 120° apart around the reduced cross-sectional dimension segment of the shaft.

Thus, while preferred constructional features of the invention are embodied in the structure illustrated herein, it is to be understood that changes and variations may be made by the skilled in the art without departing from the spirit and scope of the invention.

I claim:

1. A hand-held spin-type driver tool, comprising: a shaft of uniform cross-sectional dimension having driver means at one end and a shank segment of reduced cross-section at the other end; a plurality of rigid fin-shaped members integral with said shank segment and extending outwardly therefrom beyond the diameter of the said shaft and running parallel to each other along the entire length of said shank segment; said shank being free of recesses; and a handle grip fitted around the shank segment; said fin-shaped members contiguously engaging the surrounding handle grip so as to prevent movement between said handle grip and said shaft in the presence of torsional forces.

2. A hand-held spin-type driver tool according to claim 1, wherein said plurality of fin-shaped members comprise a pair of oppositely disposed integral fin-shaped members extending radially outward from said shank segment.

3. A hand-held spin-type driver tool according to claim 1, wherein said fin-shaped members extend outwardly from the shank segment beyond the exterior of the remaining length of said shaft.

4. A hand-held spin-type driver tool according to claim 1, wherein said shaft is in the form of a hollow tube.

5. A hand-held spin-type driver tool according to claim 1, wherein said shank segment includes a square-shaped length of shaft with said fin-shaped members extending radially outwardly from opposite corners thereof.

6. A hand-held driver tool according to claim 1, wherein said driver means comprises a member defining a surface adapted to engage a complementary shaped fastener.

7. A hand-held spin-type driver tool, comprising: a shaft of uniform cross-sectional dimension having driver means at one end and a shank segment of reduced cross-section at the other end; a pair of rigid fin-shaped members integral with said shank segment and extending radially outwardly therefrom beyond the diameter of said shaft and running parallel to each other along the entire length of said shank segment; said shank being free of recesses; and a handle grip fitted around the shank segment; said fin-shaped members contiguously engaging the surrounding handle grip so as to prevent movement between said handle grip and said shaft in the presence of torsional forces.

* * * * *

UNITED STATES PATENT OFFICE
CERTIFICATE OF CORRECTION

PATENT NO. : 3,955,451
DATED : May 11, 1976
INVENTOR(S) : William F. Lohness

It is certified that error appears in the above-identified patent and that said Letters Patent are hereby corrected as shown below:

Column 3, line 21, "were" should be --where--.

Column 4, line 41, last "the" should be --this--.

Column 5, line 10, "presense" should be --presence".

Column 5, line 11, "nut-driver" should be --nutdriver--.

Column 6, line 13, "where" should be --wherein--.

Signed and Sealed this
Thirteenth Day of July 1976

[SEAL]

*Attest:*

RUTH C. MASON
*Attesting Officer*

C. MARSHALL DANN
*Commissioner of Patents and Trademarks*